US008047897B2

(12) United States Patent
Kashiwa et al.

(10) Patent No.: US 8,047,897 B2
(45) Date of Patent: Nov. 1, 2011

(54) SUBSTRATE FLAT GRINDING DEVICE

(75) Inventors: Moriyuki Kashiwa, Annaka (JP); Etsuo Fujita, Annaka (JP); Kazuo Kobayashi, Annaka (JP); Tomio Kubo, Annaka (JP)

(73) Assignee: Okamoto Machine Tool Works, Ltd., Annaka (JP)

( * ) Notice: Subject to any disclaimer, the term of this patent is extended or adjusted under 35 U.S.C. 154(b) by 507 days.

(21) Appl. No.: 12/356,793

(22) Filed: Jan. 21, 2009

(65) Prior Publication Data

US 2009/0203299 A1 Aug. 13, 2009

(30) Foreign Application Priority Data

Feb. 13, 2008 (JP) ..... 2008-031325

(51) Int. Cl.
*B24B 49/00* (2006.01)

(52) U.S. Cl. ..... 451/11; 451/270; 451/283; 451/290

(58) Field of Classification Search ..... 451/11, 451/270, 271, 283, 285, 290, 294; 248/346.01, 248/346.03

See application file for complete search history.

(56) References Cited

U.S. PATENT DOCUMENTS

| | | | | |
|---|---|---|---|---|
| 518,730 | A * | 4/1894 | Barclay | 451/290 |
| 3,165,365 | A * | 1/1965 | Wiedemann et al. | 384/121 |
| 3,284,960 | A * | 11/1966 | Day et al. | 451/271 |
| 3,311,333 | A * | 3/1967 | Galloway | 52/295 |
| 4,726,150 | A * | 2/1988 | Nishio et al. | 451/271 |
| 5,791,976 | A * | 8/1998 | Honda | 451/288 |
| 6,042,459 | A * | 3/2000 | Honda | 451/274 |
| 6,104,202 | A | 8/2000 | Slocum et al. | |
| 6,220,945 | B1 * | 4/2001 | Hirokawa et al. | 451/287 |
| 6,652,354 | B2 * | 11/2003 | Hayashi et al. | 451/5 |
| 6,913,525 | B2 * | 7/2005 | Ishikawa | 451/174 |
| 7,175,508 | B2 * | 2/2007 | Izumi | 451/41 |
| 2002/0025764 | A1 * | 2/2002 | Katsuoka et al. | 451/41 |
| 2002/0028640 | A1 * | 3/2002 | Barnhart et al. | 451/41 |
| 2003/0150964 | A1 * | 8/2003 | Sherer et al. | 248/146 |
| 2004/0051021 | A1 * | 3/2004 | Micheel | 248/346.01 |
| 2006/0032551 | A1 * | 2/2006 | Sterner et al. | 141/314 |
| 2007/0222401 | A1 | 9/2007 | Trumper et al. | |

(Continued)

FOREIGN PATENT DOCUMENTS

JP 11 132232 5/1999

(Continued)

OTHER PUBLICATIONS

Kinematic Coupling Design for Identical "Z" Axis Repeatability, Copyright © 2006 Micro Surface Engr. Inc. Http://www.precisionballs. com/.

*Primary Examiner* — George Nguyen
(74) *Attorney, Agent, or Firm* — Oblon, Spivak, McClelland, Maier & Neustadt, L.L.P.

(57) ABSTRACT

To provide a high-rigidity flat grinding device, a substrate flat grinding device has three fastening plate lifting-and-lowering mechanisms that have kinematic couplings and a cylinder rod that move the fastening plate upward or downward. Being a high-rigidity grinding device in which the load of the fastening plate 6 also is a load on the grindstone 14 that does the grinding, there is little deflection in the thickness distribution of the substrates that are obtained, even if they are semiconductor substrates having a large substrate diameter of 450 mm.

3 Claims, 11 Drawing Sheets

U.S. PATENT DOCUMENTS

2007/0286537 A1 12/2007 Kane et al.

FOREIGN PATENT DOCUMENTS

| | | |
|---|---|---|
| JP | 11-235643 | 8/1999 |
| JP | 2000-024805 | 1/2000 |
| JP | 2000-240652 | 9/2000 |
| JP | 3472784 | 9/2003 |
| JP | 2004-364348 | 12/2004 |
| JP | 2005 022059 | 1/2005 |
| JP | 2005 262431 | 9/2005 |
| JP | 2006-220178 | 8/2006 |
| JP | 2006-220196 | 8/2006 |

* cited by examiner

SUBSTRATE FLAT GRINDING DEVICE

BACKGROUND OF THE INVENTION

1. Field of the Invention

This invention concerns a substrate flat grinding device with high rigidity including (i) a functional grinding head, (ii) a workpiece chuck rotary mechanism, (iii) a grindstone spindle tilt mechanism, and (iv) a fastening plate lifting and lowering mechanism. The functional grinding head comprises mainly a grindstone spindle capable of rotary/linear motion supported by hydrostatic bearings and a cup wheel type diamond grindstone. The workpiece chuck rotary table mechanism includes a rotary chuck table made of a porous ceramic is axial-supported by a hollow spindle equipped with hydrostatic bearings. This substrate flat grinding device improves the surface flatness of the workpieces such as bare silicon wafers, semiconductor substrates, ceramic substrates, GaAs boards, sapphire substrates, etc.

2. Background of the Invention

In a grinding for processing surface flatness of a workpiece on a rotary chuck table, a grindstone spindle equipped with a cup wheel type grindstone is rotated and lowered downward to the workpiece. The cup wheel type grindstone cuts a surface of the workpiece. In the grinding process, a tilt angle of the grindstone spindle with respect to a surface of the workpiece is changed. The feed quantity (quantity of cut-in) initially is large and gradually is made to be smaller. The tilt of the grindstone spindle is altered to prevent grinding burns and to make the distribution of the thickness of the workpiece as uniform as possible.

For example, U.S. Pat. No. 3,472,784 discloses a grinding device in which a wafer is placed onto a porous-ceramic rotary chuck table that is rotated in the horizontal plane and ground by a cup wheel type diamond grindstone attached to the lower part of a grinding spindle head that is disposed vertically, grinding devices have been proposed that have a drive means that moves the grinding spindle head and the wafer relatively in the z-axis direction, which is the perpendicular direction, a tilt means that rotates the grinding spindle head or wafer in the horizontal plane about the x-axis and y-axis, and a control means that controls the drive means and tilt means to change, either stepwise or continuously, the amount of feed of the grinding spindle head as well as the relative tilt of the grinding spindle head and the workpiece in accordance with the stage of grinding. The tilt means has a column to which is affixed a grinding spindle head raising-and-lowering means.

In Japanese unexamined patent publication H11-132232 [1999], air bearing spindles comprise a spindle main body on which is mounted a grinding grindstone that grinds the surface of the workpiece and a housing that contains radial bearings and thrust bearings that support the spindle main body with air. In an air spindle tilt adjustment mechanism, the air blowing region of the thrust bearings is partitioned into at least three regions and the pressure of the air supplied to the partitioned area blowout regions is individually adjusted, and the tilt of the spindle main body is adjusted.

In addition, in Japanese unexamined patent publication 2005-22059, a flat grinding device includes a porous-ceramic rotary chuck table that holds the workpiece, a grinding spindle head comprises a spindle equipped with a grinding wheel and is supported by air bearings and magnetic bearings that control the tilt of the grinding spindle head, sensors that detect the relative attitude of the grinding spindle with respect to the workpiece, and an attitude control means that uses detection data detected by the sensors to control the magnetic bearings to ensure that the wheel spindle assumes the preset attitude. This is done by moving the workpiece and the wheel relative to one another while the wheel is pressed against a surface of the workpiece held on the porous-ceramic rotary chuck table.

Moreover, Japanese unexamined patent application 2005-262431 discloses a grinding device including a wheel spindle equipped with a grindstone, a magnetic bearing for controlling the position of the wheel spindle, a grindstone feeding means, a rotary workpiece table, and a workpiece table feeding means which moves the workpiece table in a direction parallel to the surface to be processed. The magnetic bearing means controls the position of the grindstone spindle. The workpiece support platform feed means uses the axial-direction control current and the radial-direction control current of the magnetic bearing device, in which the stopping position of the rotating grindstone in the direction perpendicular to the surface to be processed is controlled based on the axial-direction control current of the magnetic bearing device.

Also, Japanese unexamined patent publication 2000-24805 discloses an inner cylindrical grinding device that includes a tool spindle head equipped with a grindstone, a workpiece holding means, and a feeding means that moves the grindstone of the tool spindle head toward the workpiece holding means The tool spindle head has the spindle installed through hydrostatic pressure magnetic composite bearings combining static pressure gas bearings and the magnetic bearings. Pressure sensors measuring the pressure on the bearing surface of the static pressure gas bearings are provided as a displacement measurement means that determines the displacement of the spindle, and a magnetic bearing control means is provided that determines the displacement of the spindle from the measurements of these pressure sensors and carries out magnetic force control of the magnetic bearings.

Meanwhile, although they have no particular application to grinding devices, compound (rotary/linear) actuators have been proposed that rotate or move linearly tool main shaft (spindle) that are capable of rotary/linear motion. See, for example, U.S. patent publication 2007/0222401, Japanese unexamined patent 2006-220196, Japanese unexamined patent 2004-364348, and Japanese unexamined patent publication 2006-220178.

Also known are testing devices that are equipped with a height position adjustment tool that makes use of kinematic coupling, in which male members and female members are coupled together. See for example U.S. Pat. No. 6,104,202 and Bal-tec Co., "Kinematic coupling design for the Z axis", {on-line}, pages 430-434, {searched May 30, 2005}, Internet <URL: http://www.precisionballs.com/kinematic_repeatability.html>.

In addition, grinding spindle heads are known in which the grindstone spindle that supports the rotor of a built-in motor is supported by hydrostatic pressure thrust bearings and hydrostatic pressure radial bearings and the grindstone spindle is made of a heat pipe, the heat generated by the rotor is transmitted by the heat pipe in the longitudinal direction of the grindstone spindle, and the grinding head is supported by hydrostatic bearings as a cooling structure wherein the heat is allowed to escape to the outside from the hydrostatic bearings (see for example Japanese Unexamined patent H11-235643 [1999]). Rotary chuck tables made of porous ceramic for holding a workpiece supported by water hydrostatic pressure bearings have also been proposed (see for example U.S. patent publication 2007/0286537 and Japanese unexamined patent publication 2000-240652).

SUMMARY OF THE INVENTION

When a back surface of a semiconductor substrate (workpiece) having a diameter of 200 mm or 300 mm and its thickness 100-700 μm was ground using a grinding device that tilts the grindstone spindle as described in U.S. Pat. No. 3,472,784, H11-132232 [1999] or Japanese unexamined patent publication 2005-22059 is a ground semiconductor substrate that has a thickness distribution (thickness deviation of about 1 μm) that will withstand practical use in DRAM manufacturing, even if it is thin in the middle and thick at the edges, but in the next generation DRAM semiconductor substrates having a diameter of 450 mm and a thickness of 20-50 μm, a deviation of 1 μm comes to 2-5% of the target thickness 20-50 μm, and what is required are high-rigidity substrate flat grinding devices that have a better thickness distribution (thickness deviation of less than 0.5 μm) and will not produce breaking or cracking in semiconductor substrates during grinding or transport.

Also, the semiconductor manufacturing industry does not like to get oil on a substrate during substrate processing, and would like to see the appearance of substrate flat grinding devices with water hydrostatic pressure bearings.

A first object of this invention is to provide a high-rigidity substrate flat grinding device in which a grindstone (wheel) spindle capable of rotary/linear motion is supported by magnetic bearings or thrust bearings so as to be capable of rotary and linear motion.

A second object of this invention is to apply water hydrostatic pressure bearing technology to the bearings of the grindstone spindle and workpiece spindle of a high-rigidity substrate flat grinding device, thus providing a substrate flat grinding device with water hydrostatic pressure bearings is environment friendly.

A third object of this invention is to provide a spindle lift mechanism using a new kinematic coupling mechanism.

The invention therefore provides a substrate flat grinding device including a grinding head including a functional wheel spindle, a workpiece chuck rotary mechanism, a spindle lift mechanism and a wheel spindle tilt mechanism. The wheel spindle is supported by hydrostatic pressure bearings and magnetic bearings for at least one of rotary and linear motion. The wheel spindle is equipped with a cup wheel type diamond grindstone, a rotation/linear motion composite actuators that are adapted to cause the grindstone spindle to execute rotary/linear motion; a fastening plate that fixes the grinding head in a perpendicular direction to a central position of a lower surface of the fastening plate. The workpiece chuck rotary table mechanism includes a rotary chuck table made of a porous ceramic provided below the grinding head and parallel to the bottom surface of the grindstone. The rotary table is supported by a hollow spindle supported by hydrostatic pressure bearings. The wheel spindle tilt mechanism comprises three fastening plate lifting (raising)-and-lowering mechanisms positioned at the vertices of an equilateral or isosceles triangle formed by the lower surface of the fastening plate on which the grindstone spindle is provided at a midpoint. The fastening plate lifting-and-lowering mechanisms each being adapted to independently raise and lower the fastening plate at each of the fastening plate lifting-and-lowering mechanisms.

According to a further aspect of the invention, the hydrostatic pressure bearings for the grindstone spindle comprise composite bearings compounded so that combined use parts occur mutually between the magnetic bearings and the hydrostatic pressure bearings. The hollow spindle that shaft-supports the porous-ceramic rotary chuck table is supported by hydrostatic pressure bearings.

According to yet a further aspect, each fastening plate lifting-and-lowering mechanisms of the wheel spindle tilt mechanism comprises a fastening plate height position adjustment mechanism by which the height position of the fastening plate can be determined by contact of the wedge and the bottom surface of the coupling male member, wherein each said fastening plate lifting-and-lowering mechanisms comprises a coupling female member having a V-shaped recess with a tilted bottom surface, wherein the coupling female member is fastened to a machine frame base of the workpiece chuck rotary table mechanism; a coupling male member that fits into the V-shaped recess of the coupling female member to define a space between the bottom of the coupling male member and the tilted bottom surface of the V-shaped recess; a vertical ball screw passing through holes in the coupling female member and coupling male member, the vertical ball screw having a lower end fastened for rotation on the workpiece chuck rotary table mechanism, and an upper end fastened for rotation at the lower surface of the fastening plate of the grinding head; a ball screw drive motor and encoder, and ball screw threading, attached to an upper side of the ball screw; and a wedge driven by a microservomotor, that can advance and retract in the space made by the V-shaped recess in the coupling female member and the bottom of the coupling male member, whereby the height of the fastening plate can be determined by contact of the wedge and the bottom surface of the coupling male member.

The tilt angle of the grindstone spindle with respect to the surface of the workpiece (substrate) is carried out by three fastening plate raising-and-lowering mechanisms provided in three places on the lower surface of the fastening plate, on which the grindstone spindle is provided in a perpendicular direction, so during substrate grinding, the load of the fastening plate also imposes a load on the surface of the substrate through the grindstone, and in a 450-mm-diameter substrate grinding device, it has a rigidity of 4,000-4,500 newtons, compared with the conventional rigidity of 2,000-2,500 newtons for a 450-mm-diameter grinding device. The resulting ground substrate has a superior flat thickness distribution, even with workpieces where the substrate diameter is as large as 450 mm.

Also, compared with the conventional method which tilts the two shafts of the x-axis and y-axis of the columns to which the grindstone spindle is fastened so that it can be raised and lowered, and compared with the method which tilts the grindstone spindle at three air bearing points or four magnetic bearing points, the three fastening plate height position adjustment mechanisms of the invention make it easy to set the tilt angle of the grindstone spindle to the surface of the substrate, and it is accurate and has high rigidity.

If one uses a hollow spindle to shaft-support the rotary chuck table made of a porous ceramic and uses water hydrostatic pressure bearings for the bearings of the grindstone spindle, a substrate flat grinding device results that is environment friendly.

By making the grinding head structure in which a cup wheel type grindstone is shaft-supported on the wheel spindle that is rotated and moved linearly by composite actuators, during grinding a substrate, the substrate surface is cut into or retracted from by 0- to 1.5-mm advancement and retraction motions of the grindstone spindle, and for movement of the grinding head to the standby position, a fastening plate lifting and lowering mechanism having a kinematic coupling and cylinder rod is used, and because this is done by lifting or lowering the fastening plate, the time needed for grinding can be shortened.

BRIEF DESCRIPTION OF THE DRAWINGS

In the following we refer to the drawings in describing this invention in greater detail.

DETAILED DESCRIPTION OF THE PREFERRED EMBODIMENT

Figure 1:
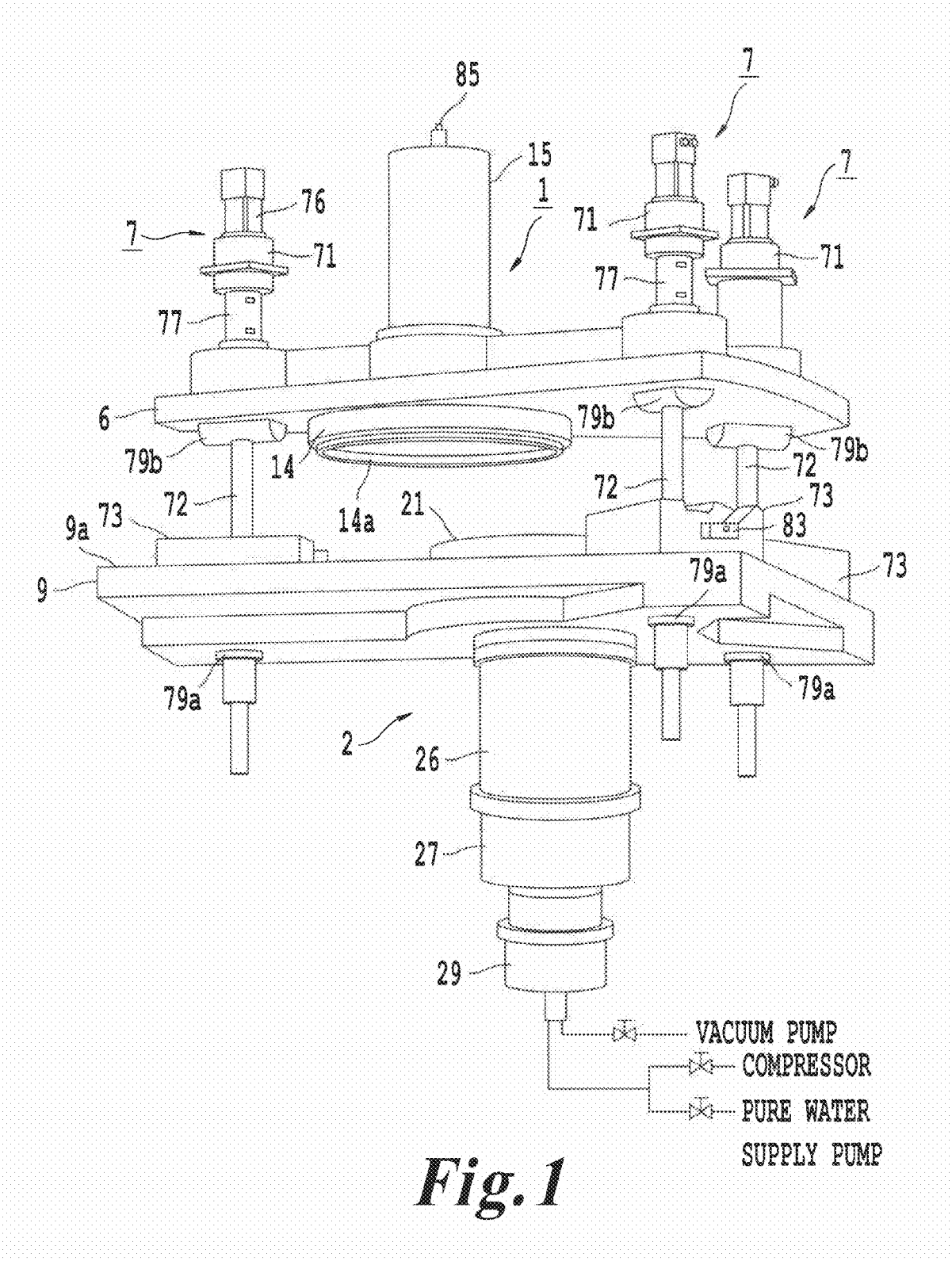
FIG. 1 is a perspective view showing the essential parts of the substrate flat grinding device of this invention, in which two of the three fastening plate lifting-and-lowering mechanisms are shown without the housing material for the ball screw.
Figure 2:
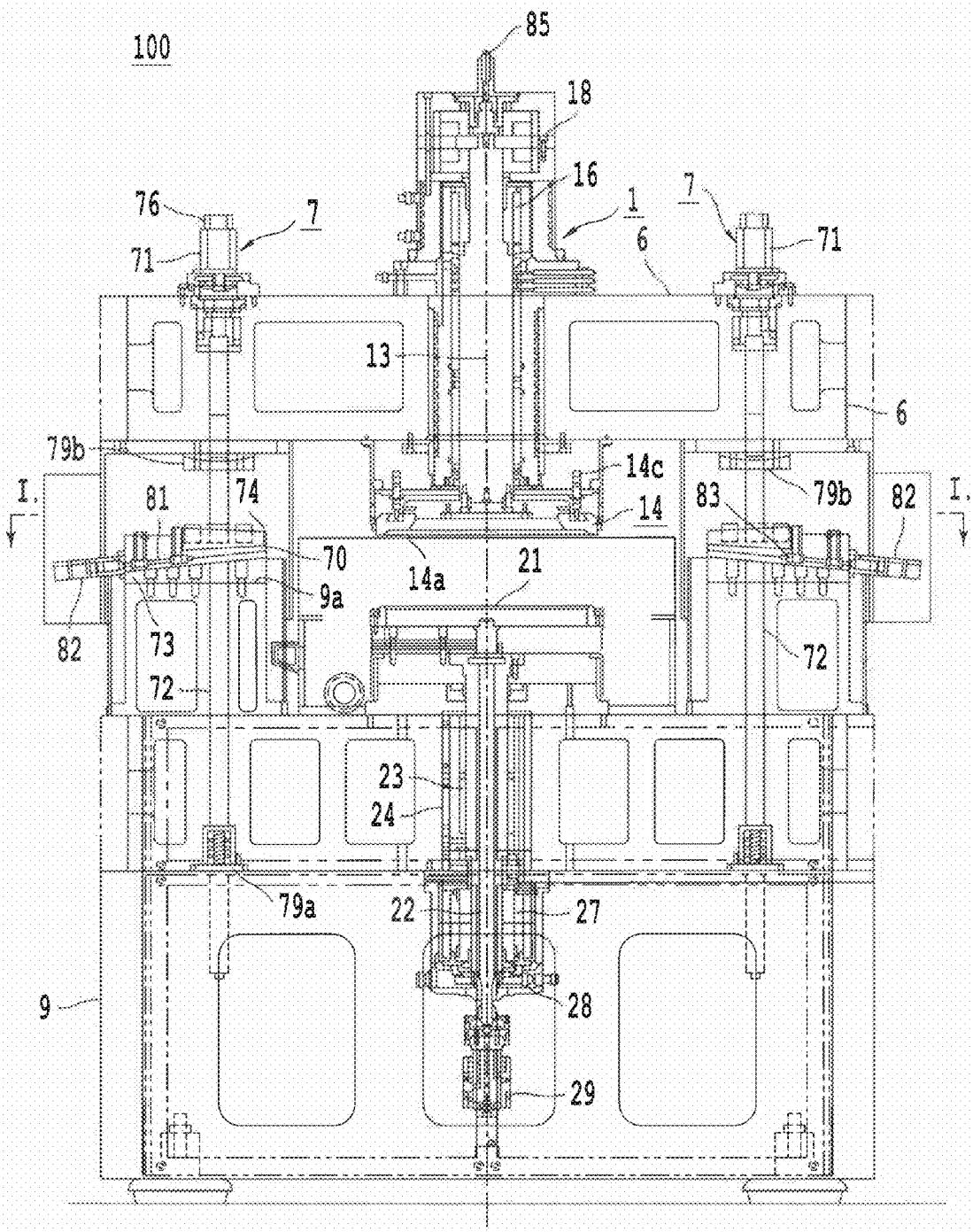
FIG. 2 is a front cross-sectional view of the flat grinding device.
Figure 3:
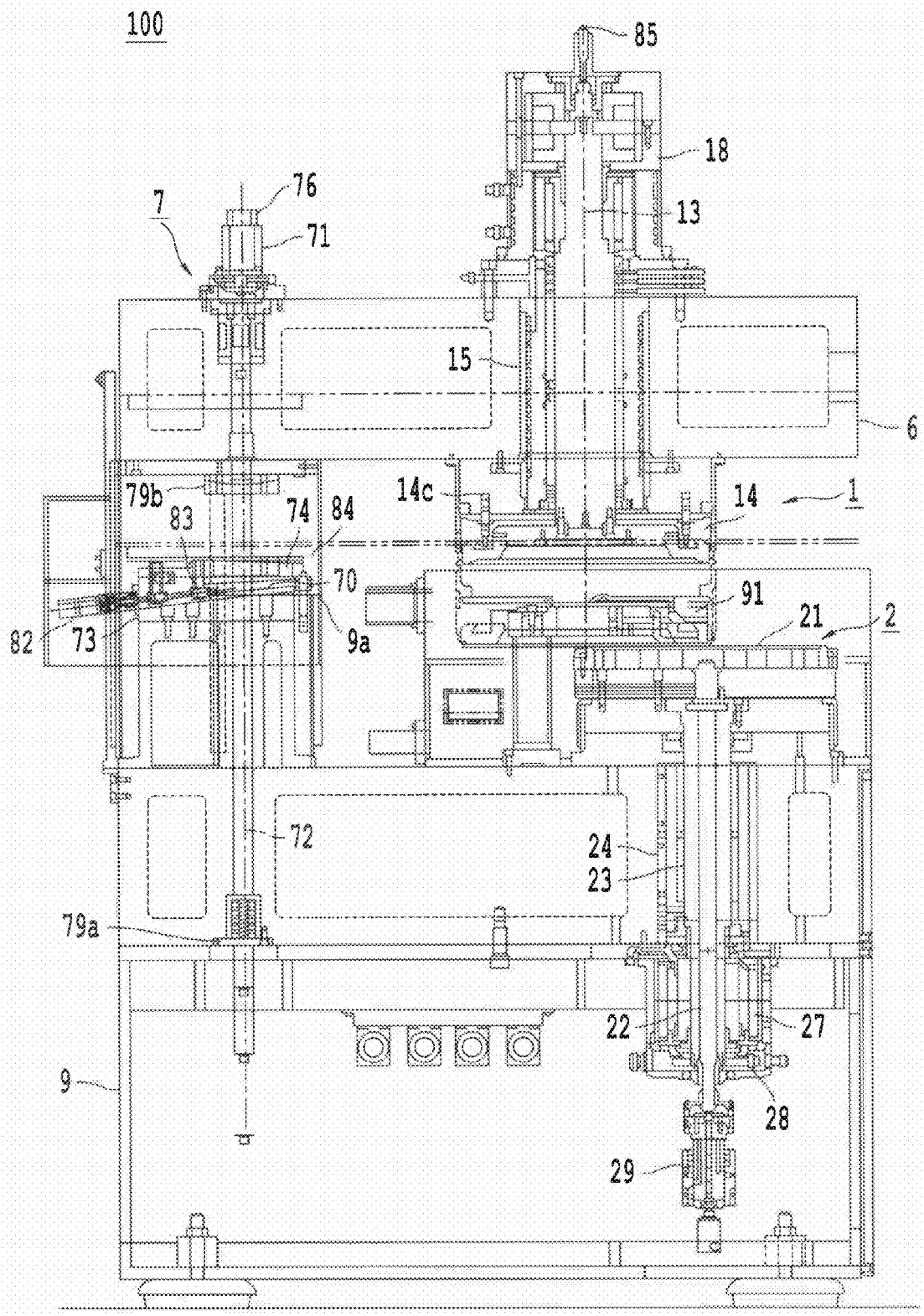
FIG. 3 is a side cross-sectional view of the flat grinding device.

As shown in FIG. 1, FIG. 2, and FIG. 3, the substrate flat grinding device 100 of this invention is assembled mainly from a workpiece chuck table mechanism 2 that is provided in a central circular cavity of machine frame 9, a grinding head 1 that is supported with hydrostatic pressure bearings and magnetic bearings, so that it can rotate and move linearly, a cup wheel type grindstone 14 that is shaft-supported by a grindstone spindle 13 that is capable of rotary and/or linear motion, a rotary/linear motion composite actuator 16, 18 that causes the grindstone spindle 13 to execute rotary and/or linear motion, and three fastening plate lifting-and-lowering mechanisms 7. Each of the three fastening plate lifting-and-lowering mechanisms has a kinematic coupling and cylinder rod that raise and lower the fastening plate 6 at three points of the vertices of an equilateral or isosceles triangle. The grinding head 1 is fixed at the center of the lower surface of the fastening plate 6, and the grindstone spindle 13 extends in a perpendicular direction thereto.

The workpiece chuck rotary table mechanism 2 is provided with a rotary chuck table 21 made of a porous ceramic, shaft-supported by a hollow spindle 22. The hollow spindle 22 is shaft-supported by hydrostatic pressure bearings, and the horizontal surface of the porous-ceramic rotary chuck table 21 is parallel to the bottom surface of the cup wheel type grindstone 14 shaft-supported by the grindstone spindle 13. The lower end of the hollow spindle 22 is connected to three supply pipes that are connected by a rotary joint 29 to a vacuum pump, compressor, and pure-water supply pump, which are not pictured. Selector valves are attached to the three supply pipes, and according to the process the substrate is undergoing, a switchover is made for reducing the pressure during suction pickup of the a workpiece, increasing the pressure when removing a substrate from the porous-ceramic rotary chuck table, and when supplying pressurized water during cleaning of the porous-ceramic rotary chuck table.

The machine frame 9 is made with a material such as marble, ceramic, black granite, resin concrete, cast steel, etc.

Each fastening plate lifting-and-lowering mechanism 7 has a coupling female member 73 having a recess 73*a* of V-shaped cross-section in its upper surface, that is fixed to the base upper surface 9*a* of the machine frame 9 of the workpiece chuck rotary table mechanism 2 and has in the middle a hole that is pierced by a ball screw 72. The bottom of the V-shaped recess of the coupling female member 73 is angled such that its height decreases toward one end. A coupling male member 74 whose cross-sectional shape is V-shaped at its lower surface and that has in the middle a hole that is also pierced by the ball screw 72. The coupling male member 74 fits into a V-shaped recess of the coupling female member 73. The ball screw 72 pierces the through-holes in the coupling female member and the coupling male member, and has a lower end rotatably fastened at a fastening fixture 79*a* at a lower portion of the machine frame base 9 of the workpiece chuck rotary table mechanism 2. The ball screw upper end is rotatably fastened at fitting plate 79*b* at the lower surface of the fastening plate 6 on the grinding head 1. A ball screw drive motor 71, an encoder 76 and ball screw threading 77 are attached to the upper end side of the ball screw 72.

Inside a space 70 made between the bottom of the V-shaped recess 73*a* in the coupling female member 73 and the bottom surface of the coupling male member 74, is positioned a wedge 83. The wedge 83 is attached to the tip of a ball screw 81 rotated by a microservomotor 82 located at the lower end of the bottom surface of the V-shaped recess so that it can advance and retract inside the space 70. The ball screw 81 is set at a tilt angle of 4-7 degrees with respect to the upper surface of the machine frame base 9*a*, the same as the slope angle of the bottom of the recess 73*a* of the female member 73. The height of the space thereby varies as the wedge is advanced and retracted.

When the wedge 83 is advanced into the space 70 made by the V-shaped recess 73*a* in the coupling female member 73, thereby rising due to the slope of the bottom surface of the V-shaped recess, and the ball screw 72 is driven such that the bottom surface of the fastening fitting plate 79*b* provided on the lower surface of the fastening plate 6 is fitted into the upper surface of the coupling male member 74 to press the coupling male member 74 downward, the bottom surface of the male member is caused to make contact with the upper surface of the wedge 83, whereby the height between the bottom surface of the fastening plate 6 and the surface of the porous-ceramic rotary chuck table 21 becomes slightly higher. On the other hand, when the wedge 83 is retracted from the space 70 and the ball screw 72 is driven such that the bottom surface of the fastening fitting plate 79*b* provided on the lower surface of the fastening plate 6 is fitted into the upper surface of the coupling male member 74 to press the coupling male member 74 downward, the bottom surface of the male member is caused to make contact with the upper surface of the wedge 83, whereby the height between the bottom surface of the fastening plate 6 and the porous-ceramic rotary chuck table 21 becomes slightly lower.

The height between the bottom surface of the fastening plate 6 and the horizontal surface of the porous-ceramic rotary chuck table 21 is thus determined by the contact of the bottom surface of the coupling male member 74 with the upper surface of the wedge 83. By the drive of the ball screw drive motor 71 of the fastening plate lifting-and-lowering mechanism 7, the fastening plate 6 is lowered. By the bottom surface of the fastening fitting plate 79*b* provided on the lower surface of the fastening plate 6 being fitted into the upper surface of the coupling male member 74, the height between the bottom surface of the fastening plate 6 and the porous-ceramic rotary chuck table 21 is fixed. Thus, the tilt angle of the grindstone spindle 13 with respect to the surface of the porous-ceramic rotary chuck table 21 is fixed by the amount of advance of the wedges 83 into the spaces 70, which can be precisely controlled by the computer control of the microservomotors 82.

Figure 4:
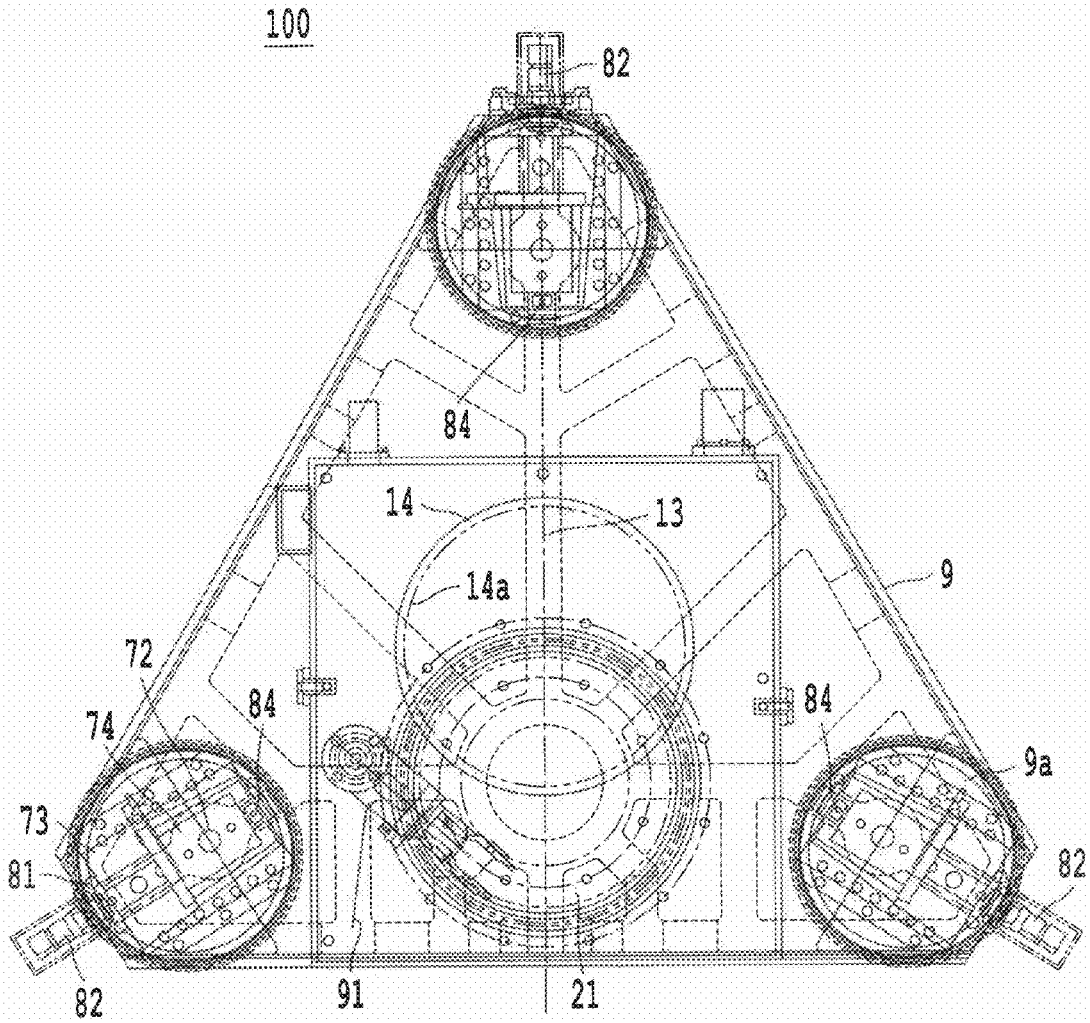
FIG. 4 is a horizontal cross-sectional view of the flat grinding device, as seen from below line I-I in FIG. 2.
Figure 5:
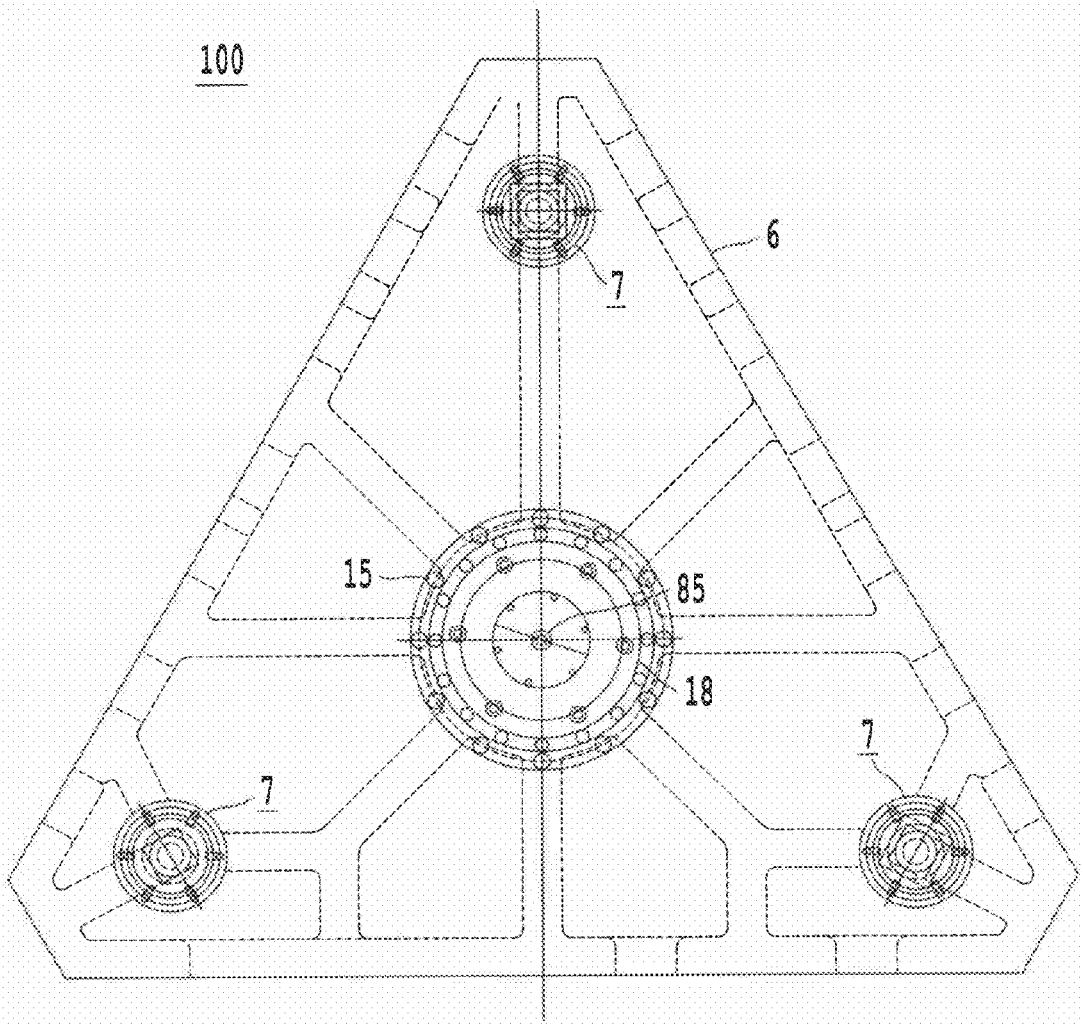
FIG. 5 is a plan view of the of the flat grinding device.

In the substrate surface grinding device 100 shown in FIG. 3 and FIG. 4, near the porous-ceramic rotary chuck table 21 of the workpiece chuck rotary table mechanism 2, a two-point process indicator 91 is provided that causes probe pins to make contact with the surface of the workpiece and the surface of the porous-ceramic rotary chuck table 21 to measure the thickness of the substrate. The thickness of the substrate is used in determining the tilt angle of the grindstone spindle with respect to the substrate surface during substrate grinding.

The ratio ($r_g/r_c$) of the diameter $r_g$ of the ring-shaped grinding blades of the cup wheel type grindstone 14 to the diameter $r_c$ of the porous-ceramic rotary chuck table 21 should be in the range 1.01-1.25. The cup wheel type grindstone 14 is shaft-supported on the grindstone spindle 13 so that the ring-shaped grinding blades of the cup wheel type grindstone 14 pass through the midpoint of the substrate.

Also, three linear sensors 84 that measure the height position of the bottom surface of the fastening plate are provided on the sides on the coupling male member 73 of the fixing plate lifting-and-lowering mechanism 7. Before the grinding process begins, correlation data on the height of the three points between the surface of the porous-ceramic rotary chuck table 21 and the bottom surface of the fastening plate, the advancement distance into and the retraction distance from the kinematic coupling portion space 70 of the three wedges 83, and the tilt angle of the grindstone spindle 13 with respect to the porous-ceramic rotary chuck table 21, are put in a table in advance, and by storing it in the memory of a numeric control device, e.g., a programmable computer having a CPU and memory, one can design a substrate grinding software program that varies the tilt angle of the grindstone spindle 13 according to the thickness of the substrate being ground. Designing a software program to vary the tilt angle of the grindstone spindle is made easier by adopting a method in which the ball screws 72 (cylinder rods) of the fastening plate lifting-and-lowering mechanism 7 support the bottom surface of the fastening plate 6 at the three vertices of an equilateral triangle.

A substrate grinding method in which during the grinding of the substrate the angle of the grindstone spindle 13 with respect to the substrate surface is varied at three different contact point positions produces a much flatter ground substrate than a method in which the substrate is ground with a single contact point position.

Figure 6:
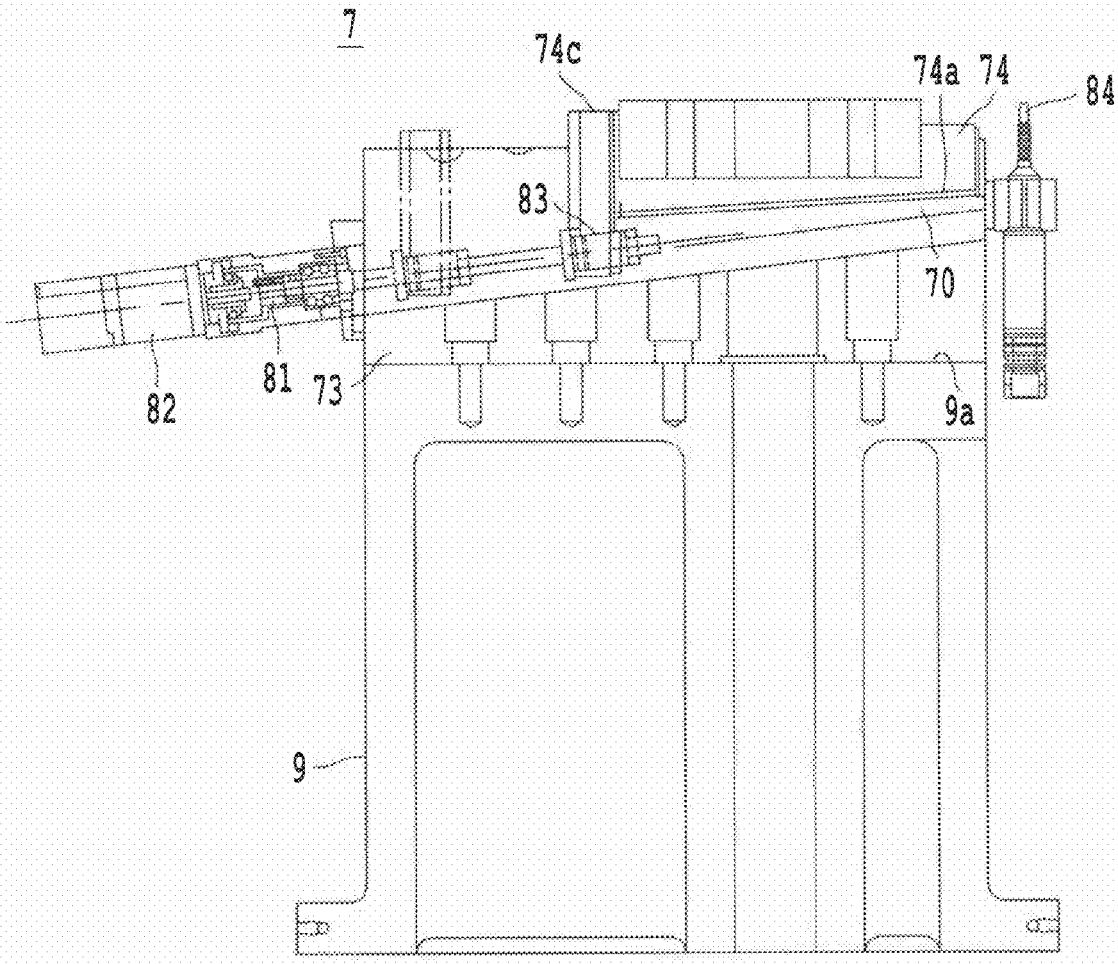
FIG. 6 is a front cross-sectional view of the kinematic coupling part of a fastening plate lifting-and-lowering mechanism.
Figure 7:
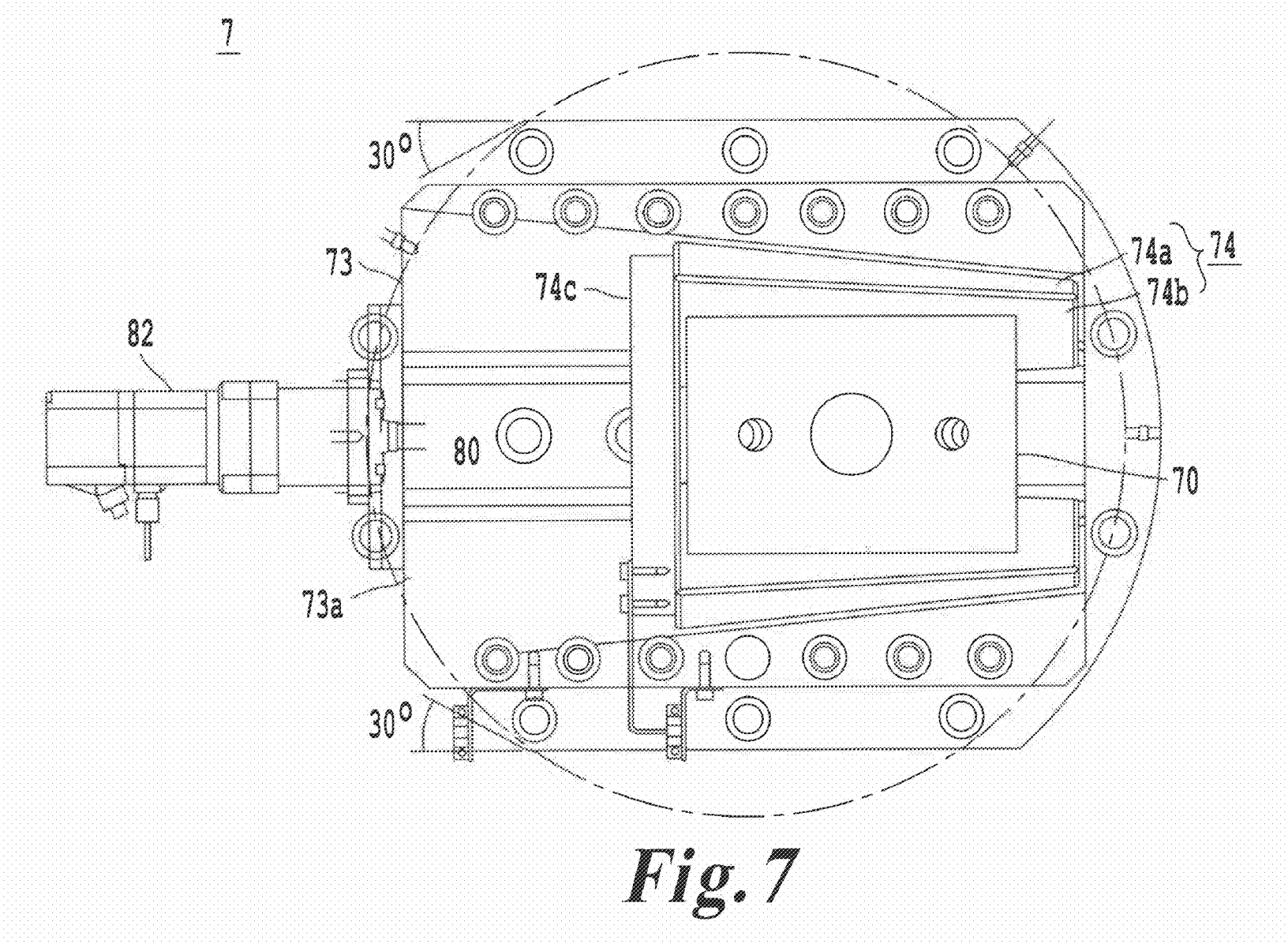
FIG. 7 is a plan view of the kinematic coupling part of a fastening plate lifting-and-lowering mechanism.
Figure 8:
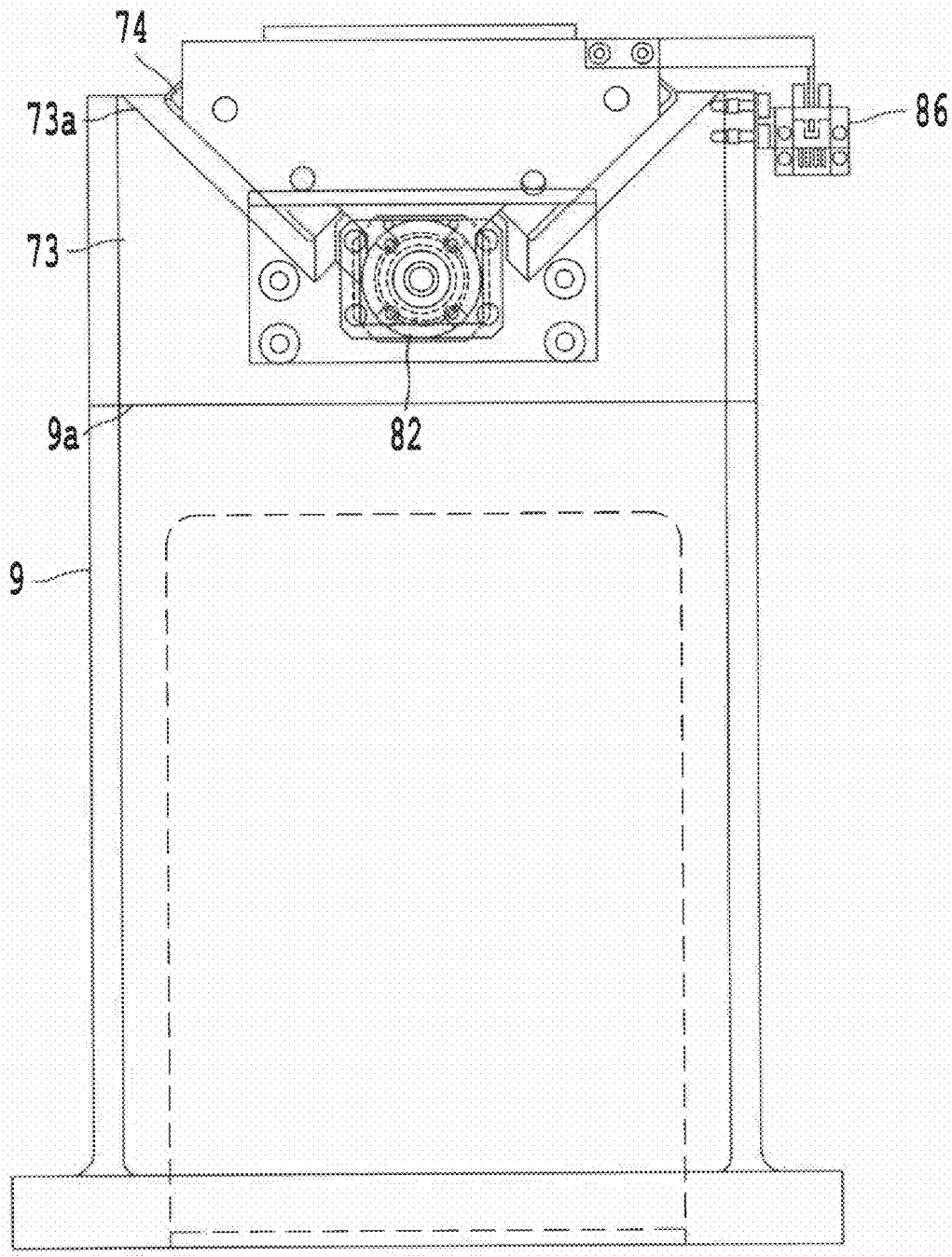
FIG. 8 is a side view of the kinematic coupling part of a fastening plate lifting-and-lowering mechanism.

In the coupling parts 73 and 74 of the fastening plate lifting-and-lowering mechanism 7 shown in FIG. 6, FIG. 7, and FIG. 8, which are pictured with the ball screws 72 removed, the female member 73 is fastened on the surface of the machine frame base 9*a* of the workpiece rotary chuck table mechanism 2. The female member 73 has a recess 73*a* with a V-shaped cross-section and a sloped bottom. Also, the female member 73 has a hole in the center that is pierced by the ball screw 72.

The male member 74, which is made up of two plates, plate 74*a* that forms the bottom and whose cross-section is roughly V-shaped and has a tilted bottom surface, and plate 74*b* which is of small width and is provided above it, and a side wall plate 74*c* that holds these two plates fixed in place. The male member has in its center a hole that the ball screw 72 pierces. The space 70 is constituted by the bottom surface of this plate 74*a* of roughly V-shaped cross-section and the V-shaped recess of the female member 73.

Figure 9:
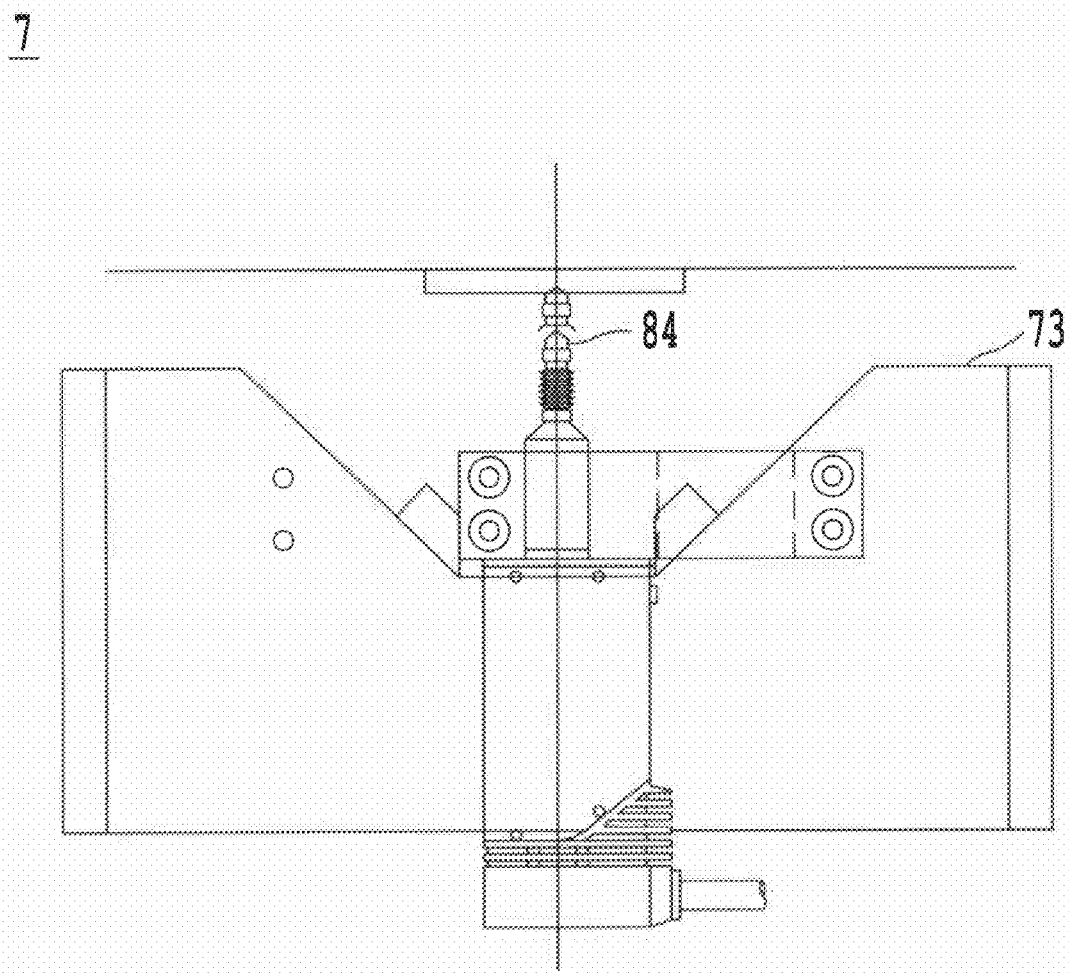
FIG. 9 is a front view of a height position measurement displacement sensor attached to the coupling part of the fastening plate lifting-and-lowering mechanism.

On the opposite side of the recess 73*a* from where the microservomotor 82 is installed, i.e., at the higher end, a linear sensor 84 is installed as shown in FIG. 4, FIG. 6, and FIG. 9. The linear sensor 84 measures the perpendicular distance between the bottom surface of the fastening plate 6 and the surface of the porous-ceramic rotary chuck table 21.

In addition, as shown in FIG. 8, attached to the side wall plate 74*c* of the male member 74, which constitutes a kinematic coupling, is a pair of height position measurement sensors 86 that have measurement probes for measuring the height of the space 70.

The programmable computer (not shown) may receive measurement outputs from the sensors 84 and 86, and control the microservomotors 82 according to the stored program.

The fastening plate lifting-and-lowering mechanism 7 may be any height adjustment device that has a kinematic coupling and cylinder rod that can move the height position of the fastening plate 6. For example, instead of the above-described servomotor-driven ball screw 72, one could use a fastening plate raising-and-lowering mechanism that employs a cylinder rod that can be moved up or down by a pneumatic or hydraulic cylinder. Also, the position of the ball screw drive motor of the above-described fastening plate lifting-and-lowering mechanism 7 may be reversed top and bottom with the machine frame base 9*a* base side. In addition, one may also use a construction in which the structure of the kinematic coupling female member 73 and male member 74 is changed to a well known kinematic coupling structure.

Figure 10:
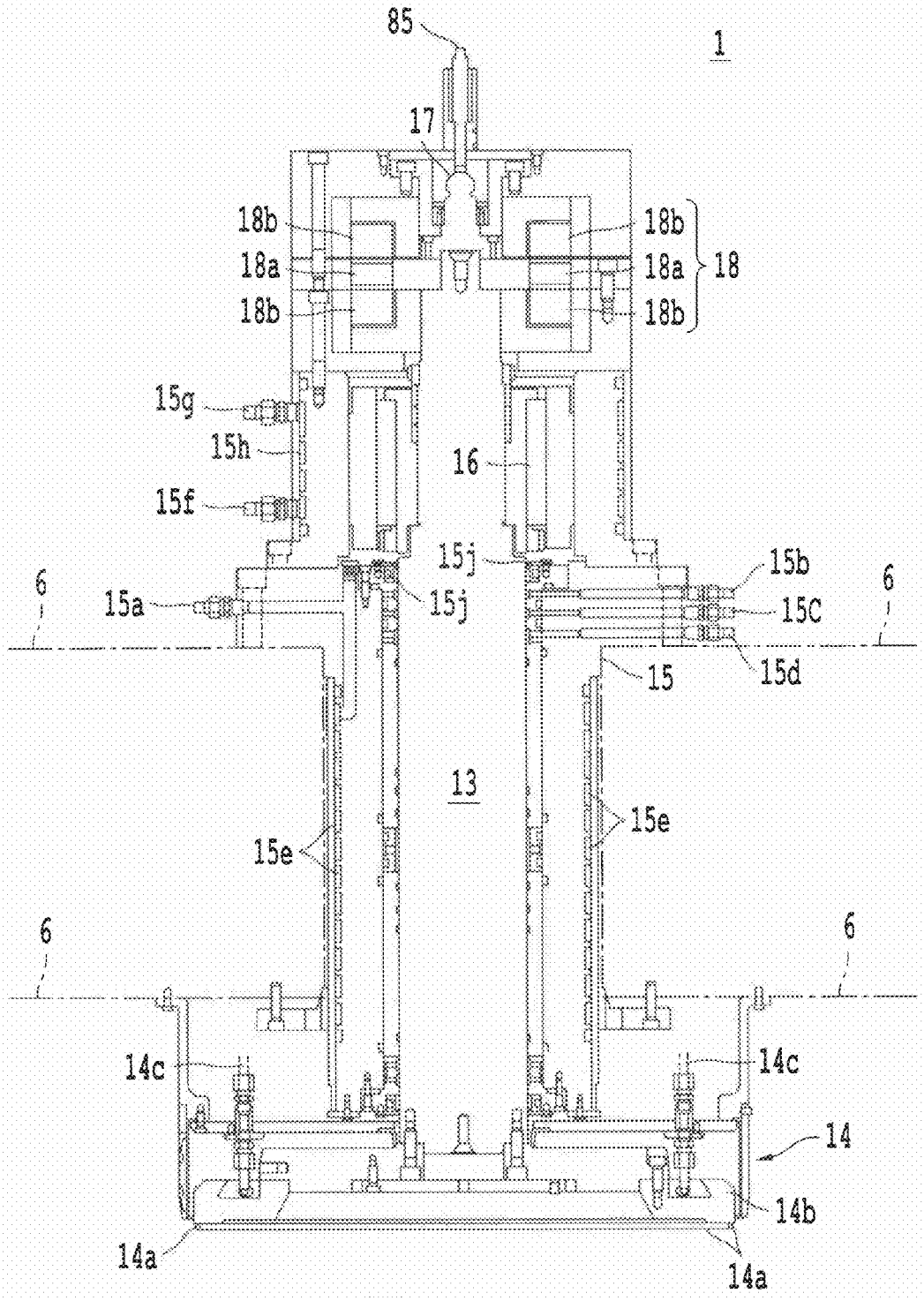
FIG. 10 is a cross-sectional view of the grinding head.

Next, referring to FIG. 10 to describe in detail the structure of the grinding head 1, while referring to FIG. 2 and FIG. 3, as shown in FIG. 10, the grinding head 1, which shaft-supports a cup wheel type grindstone 14 below the grindstone spindle 13, is set in the grindstone spindle processing standby position so that the bottom surface of the blade tips (segments) 14*a* of the cup wheel type grindstone 14, which are arrayed in a ring, is parallel to the surface of the porous-ceramic rotary chuck table 21.

The grinding head 1 is suspended from the midpoint of the bottom surface of the fastening plate 6 whose plane is on an equilateral triangle, so that its lower end is a cup wheel type diamond grindstone 14.

The blade tips 14*a* of the cup wheel type grindstone 14 are arrayed in a ring on the lower surface of the grindstone flange 14*b*, and grinding fluid is supplied from fluid supply nozzles 14*c*, 14*c* to a ring-shaped recess groove provided on the upper surface of the grindstone flange 14*b*. The grindstone spindle can be set to turn at up to 5,000 rpm, and during substrate grinding a rotation speed of 1,000-2,500 rpm is used.

The grindstone spindle 13 is surrounded by a cylindrical housing 15, and the lower part of the grindstone spindle 13 is hydrostatic pressure radial shaft-supported. Provided on the inside wall of the cylindrical housing 15 is a water channel 15*e*, and water is supplied to the water channel 15*e* from a water supply opening 15*a*. Water that flows between the inner wall of the cylindrical housing 15 and the outside of the grindstone spindle 13, cooling the grindstone spindle 13, is discharged by a vacuum suction pipe 15*b*. The structure is such that after substrate grinding has been completed, pressurized air is supplied from a pressurized air supply opening 15*c*, and the cooling water and drops that remain inside the water channel 15*e* are discharged by a drain pipe 15*d* to outside the cylindrical housing.

In the middle part of the grindstone spindle 13 is a built-in motor 16 that rotates the grindstone spindle 13 horizontally; with the built-in motor 16, the coolant that is supplied from a coolant introduction pipe 15*f* that is provided in the cylindrical housing 15 is led through a cooling fluid flow path 15*h* provided on the inner wall of the cylindrical housing 15 to a drain pipe 15*g*.

The chamber that is radially shaft-supported and the coolant chamber with the built-in motor 16 are separated by a lip seal 15*j* so that the liquids that are supplied into each chamber do not get mixed together.

Mounted above the grindstone spindle 13 is a position sensor 85, which is a position detection element of the ball target 17 provided on the top end of the grindstone spindle 13, and a coil 18*b* for moving the grindstone spindle 13, to which a needle (permanent magnet) 18*a* is affixed, up or down by about 0. -1.5 mm.

Rotation of the grindstone spindle 13 can be effected by the built-in motor 16, and thrust linear motion of the grindstone spindle 13 by up to 1.5 mm can be effected by a motor 18, which is a combination of the needle 18*a* and the coil 18*b*; these motors 16 and 18 are called collectively rotary/linear compound actuators.

The structure of the rotary/linear compound actuators of the grindstone spindle may be the structure of the spindle rotary/linear compound actuators disclosed in U.S. patent publication 2007/0222401, which is hereby incorporated by reference.

Figure 11:
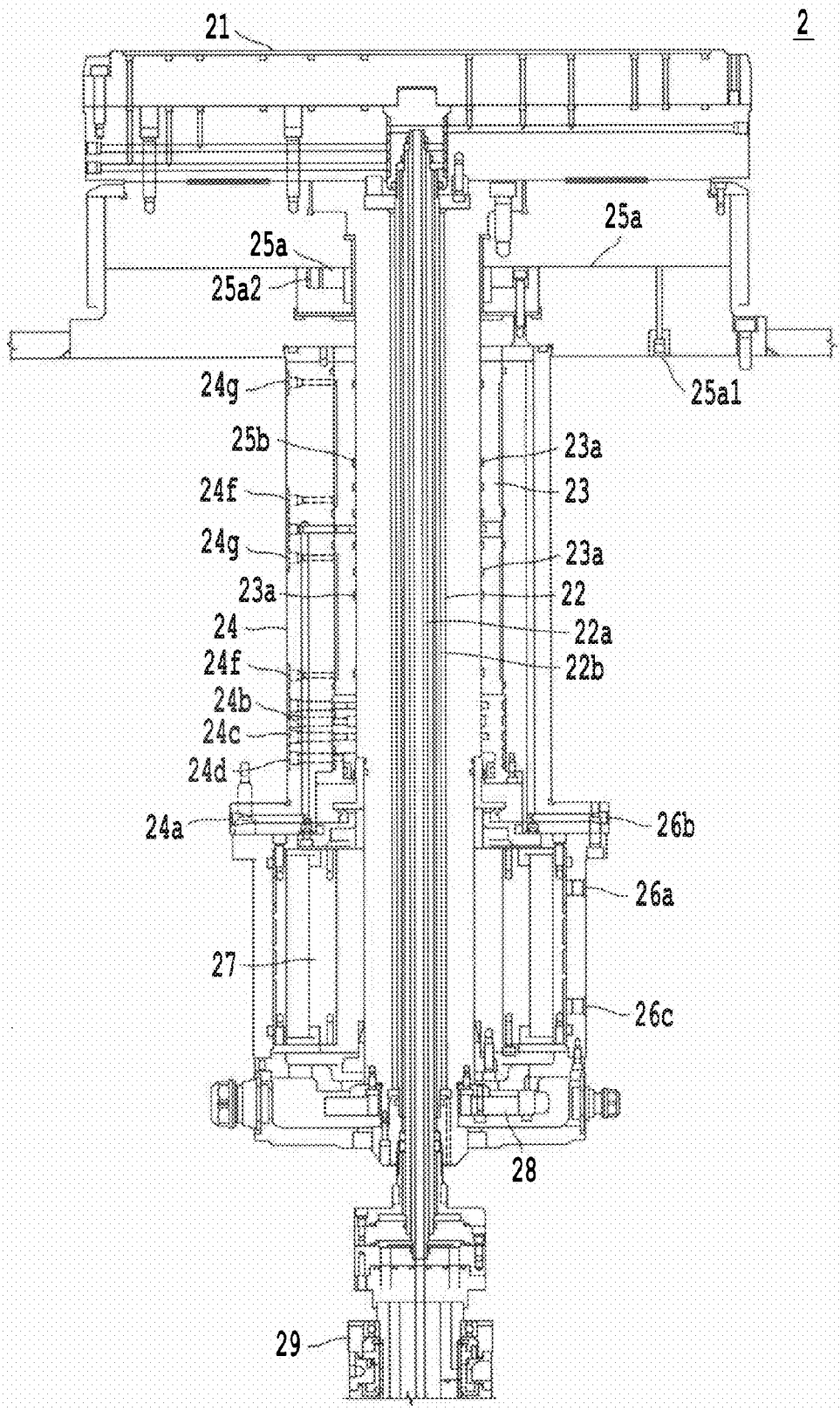
FIG. 11 is a cross-sectional view of the workpiece chuck rotary table.

Next, referring to FIG. 2, FIG. 3, and FIG. 11, we describe in detail the structure of the workpiece chuck rotary table mechanism 2. The workpiece chuck rotary table mechanism 2 has a cylindrical bushing 23 made of a silicon nitride ceramic on which are provided a hollow spindle 22 that shaft-supports the porous-ceramic rotary chuck table 21 and a water channel 23*a* on the inner circumferential wall. A cylindrical housing member 24 that has a water supply opening 24*a* that supplies water to the water channel 23*a* of this cylindrical bushing is made of $S_iC$ ceramic, a reduced-pressure discharge opening 24*b* through which water is discharged, and a pressurized air supply opening 24*c* that supplies pressurized air for draining the water remaining in the water channel 23*a* from a drain discharge opening 24*d*. A thrust bearings 25*a* is provided above the hollow spindle 22 and radial bearings 25*b* provided in the middle part of the hollow spindle 22. A built-in motor 27, which is a hollow spindle rotation drive mechanism, is provided in the lower part of the hollow spindle 22. An encoder is shown at 28. A rotary joint 29 is coupled at the lower end of the hollow spindle 22. A vacuum pump is a pressure reduction mechanism that through this rotary joint 29 reduces the pressure of the fluid inside the hollow spindle 22 pipe. A compressor is a pressurized air supply mechanism that pressurizes the air inside the hollow spindle pipe. Pipes 22*a* and 22*b* are connected to a water supply pump that supplies pure water into the hollow spindle 22 pipe.

Good materials for the hollow spindle 22 and cylindrical bushing 23 include ceramics such as silicon nitride, silicon carbide, silicon oxide, alumina, zirconia, etc., but one may also coat the surface of a spindle made of conventional stainless steel or chromium-plated steel with a coating 100-500 μm thick by ceramic chemical vapor deposition.

In the water channel of the thrust bearings 25*a*, pure water is supplied by eight pure water supply nozzles $\mathbf{25}a_1$ and water is discharged by a drain pipe $\mathbf{25}a_2$. Water is supplied to the water channel 23*a* of the radial bearings 25*b* from the water supply opening 24*a*, and is discharged from the reduced pressure discharge opening 24*b*. The cooling water for the built-in motor 27 is supplied from a water supply opening 26*a* and is discharged from a discharge opening 26*b*. The cooling water that cools the built-in motor 27 is supplied from a water supply opening 26*a* and is discharged from a discharge opening 26*b*.

The workpiece (substrate) is placed on the porous-ceramic rotary chuck table 21, the vacuum pump is operated, the workpiece is fastened in place on the porous-ceramic table 21, then the hollow spindle 22 is rotated horizontally by the built-in motor 27. The hollow spindle 22 can rotate at up to 500 rpm, and during substrate grinding it is rotating at 50-200 rpm.

The following describes the process of grinding a substrate to make it flat, using the substrate flat grinding device 100 shown in FIG. 1.

Using a conveyance robot or a conveyance pad, the substrate is first placed onto the porous-ceramic rotary chuck table 21, then the vacuum pump is operated to reduce the pressure in the pressure reduction chamber 21*a* at the bottom surface of the porous-ceramic rotary chuck table, and the substrate is fastened to the porous-ceramic rotary chuck table 21. The built-in motor 27 is then operated to rotate the hollow spindle 22.

The grinding head 1, which is in standby position, is then lowered, at which time the three ball screws 72 of the fastening plate lifting-and-lowering mechanisms 7 are operated, and after the fastening plate 6 is lifted, the wedges 83 are advanced into the spaces 70 formed by the coupling female members 73 and the coupling male members 74 of the fastening plate raising-and-lowering mechanisms 7. Then the ball screws 72 are driven until the bottom surfaces of the fastening fitting plates 79*b* provided on the lower surface of the fastening plate 6 are fitted into the upper surfaces of the coupling male members 74, pushing down the coupling male members 74 and causing the bottom surface of the male members to make contact with the upper surface of the wedges 83, setting the height between the bottoms surface of the fastening plate 6 and the surface of the porous-ceramic rotary chuck table 21. By the bottom surfaces of the fastening fitting plates 79*b* provided on the lower surface of the fastening plate 6 being fitted into the upper surfaces of the coupling male members 74, the height between the bottom surface of the fastening plate 6 and the porous-ceramic rotary chuck table 21 is fixed. In other words, the tilt angle of the grindstone spindle 13 with respect to the surface of the porous-ceramic rotary chuck table 21 is fixed by the degree of advancement of the wedges 82 into the spaces 70.

Then, the cup wheel type diamond grindstone 14 is rubbed against the rotating substrate surface, and grinding cut-in of the substrate begins. At this time, grinding fluid is supplied from a supply nozzle 14*c* into the upper groove of flange 14*b* of the cup wheel type diamond grindstone 14, and the grinding fluid is supplied to the surface of the substrate through a through-hole provided at a slant on the flange wall, cooling the substrate and the grinding blade 14*a* of the cup wheel type diamond grindstone 14. The downward feed-in of the grindstone spindle 13 for cut-in of the substrate is done by grindstone spindle feed by the rotary/linear compound actuators.

During grinding, the thickness of the substrate is measured by a two-point process indicator 91, and in order to make the height position of the fastening plate 6 as instructed in the grindstone spindle tilt program that prescribes the tilt angle of the grindstone spindle 13 with respect to the surface of the substrate based on the measured thickness, the fastening plate 6 is lifted somewhat by raising the ball screws 72 of the fixing plate lifting-and-lowering mechanisms 7 and expanding somewhat the height of the spaces 70 of the female members 73 and the male members 74. To this end, the wedges 83 attached to the tips of an advanceable-retractable ball screws 81 are advanced by the drive of two microservomotors 82, and the wedge 83 attached to the tip of the other advanceable-retractable ball screw 81 is retracted by the drive of the one other microservomotor 82. Next, the ball screws 72 are driven and the coupling male members 74 are again pressed downward so that the bottom surface of the male members make contact with the upper surface of the wedges 83, setting the height between the bottom surface of the fastening plate 6 and the surface of the porous-ceramic rotary chuck table 21. The tilt angle of the grindstone spindle set with respect to the surface of the porous-ceramic rotary chuck table 21 thereby approaches the programmed value.

By the lowering of the ball screw 72 of the fastening plate lifting-and-lowering mechanism 7, the grindstone spindle 13, whose angle has been adjusted, is brought into contact with the substrate surface of the grinding blades 14*a* of the cup wheel type diamond grindstone 14, and the rubbing of the substrate surface by the grindstone blades 14*a* is resumed. The downward feed-in of the grindstone spindle for the cutting-in of the substrate is done by grindstone spindle feeding by the rotation/linear motion compound actuators 16, 18.

The measurement of the substrate thickness and adjustment of the grindstone spindle tilt angle and the substrate rubbing are repeated. The grindstone spindle tilt angle is gradually reduced so that when the thickness of the substrate approaches or reaches the final thickness, the tilt angle of the grindstone spindle 13 with respect to the substrate surface becomes 0 degrees (the bottom surface of the fastening plate 6 or the bottom surface of the ring-shaped set of grindstone blades 14*a* of the cup wheel type diamond grindstone, and the horizontal surface of the substrate or the surface of the machine frame base 9*a*, are parallel).

After completion of the substrate grinding process, by raising the ball screws 72 of the fastening plate lifting-and-lowering mechanisms 7, the grinding head 1 is retracted upward, and a return is made to the standby position away from the ground substrate. In the grinding head standby position, the distance to the bottom surface of the fastening plate 6 is measured using a linear sensor 84, and it is confirmed whether the tilt angle of the grindstone spindle 13 with respect to the substrate surface is 0 degrees. If it is not 0 degrees, the raising or lowering of the three ball screws 72 of the fastening plate lifting-and-lowering mechanism 7 is adjusted, and an adjustment is made so that the tilt angle of the grindstone spindle 13 with respect to the substrate surface is 0 degrees.

After stopping the rotation of the porous-ceramic rotary chuck table 21, operation of the vacuum pump is stopped. Then pressurized water is supplied to the bottom surface of the porous-ceramic rotary chuck table 21, making it easy to peel off the ground substrate from the surface of the porous-ceramic rotary chuck table 21.

The ground substrate is picked up by suction by a conveyance robot or conveyance pad, and the ground substrate is moved from the surface of the porous-ceramic rotary chuck table 21 to the next processing step.

After cleaning the surface of the porous-ceramic rotary chuck table 21 by means of a porous-ceramic rotary chuck table cleaning device that is not pictured in the drawings, cleaning of the porous-ceramic rotary chuck table is done by jet-flushing (spraying) pressurized water for 0.1-0.5 seconds by the bottom surface 21*a* of the porous-ceramic rotary chuck table.

POTENTIAL FOR INDUSTRIAL USE

The substrate flat grinding device 100 of this invention is a high-rigidity flat grinding device in which during substrate grinding the load of the fastening plate also imposes a load on the surface of the substrate through the grindstone, because three fastening plate lifting-and-lowering mechanisms are arranged that each have a kinematic coupling and a ball screw (lifting-and-lowering cylinder rod) at three points on the lower surface of the fastening plate 6 that lowers the grinding head 1 in adjustment of the tilt angle of the grindstone spindle 13 with respect to the substrate surface. Consequently, even with a large workpiece having a substrate diameter of 450 mm, a ground substrate is obtained that has excellent flatness.

What is claimed is:

1. A substrate flat grinding device comprising:

a grinding head including a grindstone spindle that is supported by hydrostatic pressure bearings and magnetic bearings for at least one of rotary and linear motion, wherein the grindstone spindle equips a cup wheel type grindstone;

rotation/linear motion compound actuators that are adapted to cause the grindstone spindle to execute rotary/linear motion;

a fastening plate that fastens the grinding head in a perpendicular direction to a central position of a lower surface of the fastening plate;

a workpiece chuck rotary table mechanism having a rotary chuck table provided below the grinding head and parallel to the bottom surface of the grindstone, wherein the rotary table is supported by a hollow spindle supported by hydrostatic pressure bearings; and three fastening plate lifting-and-lowering mechanisms positioned at the vertices of an equilateral or isosceles triangle formed by the lower surface of the fastening plate on which the grindstone spindle is provided at a midpoint, the fastening plate lifting-and-lowering mechanisms each being adapted to independently raise and lower the fastening plate at each of the fastening plate lifting-and-lowering mechanisms.

2. The grinding device as recited in claim 1, wherein:

the hydrostatic pressure bearings for the grindstone spindle comprise composite bearings compounded so that combined use parts occur mutually between the magnetic bearings and the hydrostatic pressure bearings, and the hollow spindle that shaft-supports the porous-ceramic rotary chuck table is supported by hydrostatic pressure bearings.

3. The grinding device as recited in claim 1, wherein each said fastening plate lifting-and-lowering mechanisms comprises a fastening plate height position adjustment mechanism, wherein each said fastening plate lifting-and-lowering mechanisms comprises:

a coupling female member having a V-shaped recess with a tilted bottom surface, wherein the coupling female member is fastened to a machine frame base of the workpiece chuck rotary table mechanism;

a coupling male member that fits into the V-shaped recess of the coupling female member to define a space between the bottom of the coupling male member and the tilted bottom surface of the V-shaped recess;

a vertical ball screw passing through holes in the coupling female member and coupling male member, the vertical ball screw having a lower end fastened for rotation on the workpiece chuck rotary table mechanism, and an upper end fastened for rotation at the lower surface of the fastening plate of the grinding head;

a ball screw drive motor and encoder, and ball screw threading, attached to an upper side of the ball screw; and a wedge driven by a microservomotor, that can advance and retract in the space made by the V-shaped recess in the coupling female member and the bottom of the coupling male member, whereby the height of the fastening plate can be determined by contact of the wedge and the bottom surface of the coupling male member.

* * * * *